United States Patent [19]

Loughlin

[11] 4,420,658

[45] Dec. 13, 1983

[54] MULTIPLE TONE SIGNAL SYSTEM

[75] Inventor: Bernard D. Loughlin, Centerport, N.Y.

[73] Assignee: Hazeltine Corporation, Greenlawn, N.Y.

[21] Appl. No.: 260,645

[22] Filed: May 4, 1981

[51] Int. Cl.[3] ..... H04H 5/00

[52] U.S. Cl. ..... 381/15; 307/524

[58] Field of Search ..... 179/1 GN, 1 GS; 307/510–512, 522, 524, 525; 329/111, 112, 135, 136; 455/59–61, 108, 109, 154

[56] References Cited

U.S. PATENT DOCUMENTS

| | | | |
|---|---|---|---|
| 3,384,824 | 5/1968 | Grenier | 455/60 X |
| 3,518,556 | 6/1970 | Holmboe et al. | 307/525 X |
| 3,679,832 | 7/1972 | Halpern | 179/1 GN |
| 3,980,832 | 9/1976 | Nakamura et al. | 179/1 GN |
| 4,016,366 | 4/1977 | Kurata | 179/1 GN |
| 4,087,628 | 5/1978 | Sanders et al. | 329/111 X |
| 4,165,486 | 8/1979 | Yoshisato | 455/109 X |
| 4,344,038 | 8/1982 | Streeter | 179/1 GS |

*Primary Examiner*—A. D. Pellinen

*Attorney, Agent, or Firm*—E. A. Onders; F. R. Agovino

[57] ABSTRACT

Multiple low frequency tones are employed for stereo indication in an AM stereo radio system. The tones are modulated on a carrier wave which is also multiplex modulated by stereo related audio signals. Detection of the presence of one of the tones in a received signal provides an indication of the possibility of stereo related modulation components in the received signal. Detection of the presence of both tones in the received signal provides confirmation that stereo related modulation components are in the received signal. In a preferred embodiment, 15 Hz and 30 Hz phase-related tones are used. A stereo receiver incorporates 15 Hz and 30 Hz phase detectors which form interrelated phase-locked loops with a 30 Hz reference oscillator. The presence of both tones in the proper phase relationship indicates reception from an AM radio station which is broadcasting in stereo.

6 Claims, 5 Drawing Figures

MULTIPLE TONE SIGNAL SYSTEM

BACKGROUND OF THE INVENTION

1. Field of the Invention

This invention generally relates to the use of a pilot signal modulated on a carrier to indicate that the carrier also includes a particular type of data or information, such as stereo or multiphonic related modulation components. In particular, the invention relates to AM stereo systems wherein a carrier wave having stereo related modulation components is provided with a low frequency pilot signal modulation component to indicate the presence of stereo information.

2. Description of the Prior Art

Compatible stereophonic AM radio systems and single side band systems are well known, as illustrated by prior U.S. Pats. Nos. 3,218,393 and 2,020,327. Furthermore, the use of a pilot signal in AM stereo systems to indicate the presence of stereo information in the transmitted signal is also well known, as illustrated by U.S. Pat. No. 3,944,749.

The proposed AM stereo systems of the prior art disclose the incorporation of a single low-frequency pilot tone (such as 15 Hz) which is suitably modulated on the radio frequency (RF) carrier at the transmitter. At the receiver, the pilot tone is detected and used to enable the stereo signal decoder and a stereo indicator lamp. However, such prior art systems are adversely affected by low frequency noise and interference which may cause false stereo channel enabling or stereo indication. For example, co-channel interference can create relatively strong low frequency components which may falsely trigger a 15 Hz stereo pilot signal detector, thereby causing the receiver to produce a false indication of stereo reception.

SUMMARY OF THE INVENTION

It is, therefore, an object of the present invention to provide an information indicating system which has improved reliability in the presence of low frequency noise and interference.

It is another object of this invention to provide an information indicating system for use in an information broadcasting system, wherein said indicating system provides a first indication of the likely presence of the information and a second indication which may be used to confirm that the information is being received.

It is still another object of this invention to provide a reliable information indicating system which is particularly useful in AM stereo receivers designed for installation in automobiles.

To achieve the above objects, the present invention comprises a system for transmitting particular information along with a pilot signal to indicate that the particular information is being transmitted. Specifically, the invention includes an apparatus for providing a carrier signal including the particular information and a pilot signal modulated thereon. The apparatus comprises means for generating a carrier signal, means for generating the particular information, a first signal generator and a second signal generator. The apparatus further includes means for modulating the particular information onto the carrier signal and means for modulating the first and second signals onto the carrier signal. Means are provided for transmitting the carrier signal, including the modulated particular information and the first and second signals. The invention further includes an apparatus for detecting the transmitted signals comprising first means for detecting the presence of the first signal modulated on the carrier wave and providing a first detection signal in response thereto, and second signal modulated on the carrier wave and providing a second detection signal in response thereto. A third means is included for detecting the presence of both the first detection signal and the second detection signal and providing a signal indicating the presence of the particular information in response to the detection of these signals.

For a better understanding of the present invention, together with other and further objects, reference is made to the following description, taken in conjunction with the accompanying drawings, and its scope will be pointed out in the appended claims.

DETAILED DESCRIPTION OF THE INVENTION

In general, the multi-tone pilot signaling system according to the invention may be used in any transmission system wherein a carrier wave has particular intelligence modulated thereon and a reliable indication that the intelligence is being transmitted with the carrier wave is necessary. Specifically, a two-tone stereo pilot signal system may be employed with a system for receiving a compatible radio frequency carrier wave with stereo related intelligence appearing as upper and lower sidebands of the carrier wave. First and second signals, such as low frequency tones of 15 Hz and 30 Hz, are modulated on the carrier wave along with the stereo related intelligence to indicate stereo presence and/or to control the receiver audio output mode.

Figure 1A:
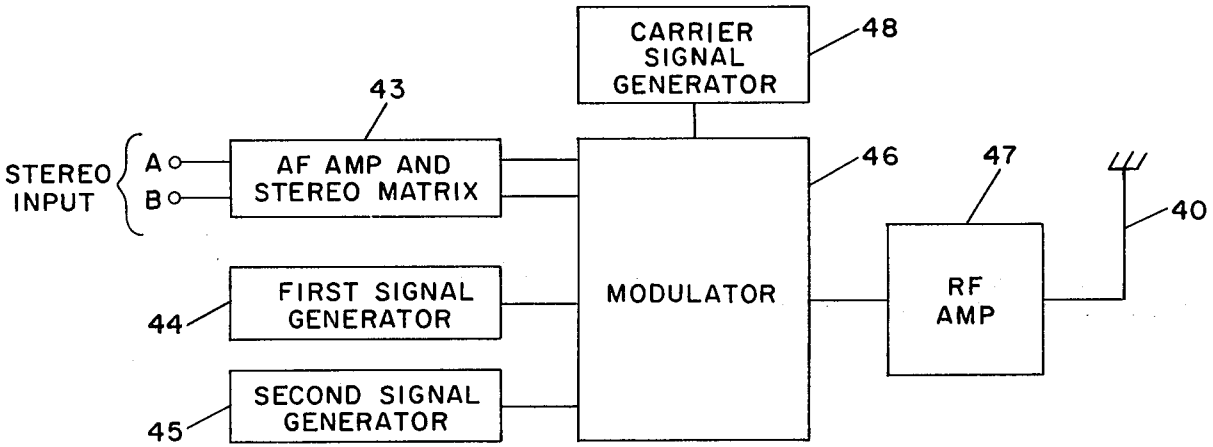
FIGS. 1A and 1B are block diagrams illustrating a system according to the invention, using a two-tone stereo pilot signal modulated on a carrier to indicate that the carrier also includes stereo modulation components.

The system according to the invention for transmitting the particular intelligence, such as stereo information, and the two-tone pilot signal is illustrated in block form in FIG. 1A. Stereo inputs A and B are provided to audio frequency amplifiers and stereo matrix 43 which amplify the audio stereo information and provide amplified and matrixed signals to modulator 46. Modulator 46 is also provided with a carrier signal from generator 48 and the pilot tones in the form of the first signal from generator 44 and the second signal from generator 45. Modulator 46 may include AM as well as PM and/or FM component portions for modulating the stereo information as well as the first and second signals onto the carrier signal and providing a modulated signal to radio frequency amplifier 47 for transmission by antenna 40. The particular type of modulation of the first and second signals and the particular type of information modulated onto the carrier signal is dependent upon the sytem desired and it is contemplated that amplitude, phase or frequency modulation may be employed.

As disclosed in U.S. Pat. Nos. 3,218,393, 3,908,090, 3,944,749, and 4,018,994, a carrier signal modulated with stereo intelligence may be received by an amplitude modulation stereophonic transmission receiver having a front end portion comprising a superheterodyne system in its RF and IF stages. The output from the IF amplifier/filter may be demodulated and detected. The demodulated and detected signals are ultimately applied to an audio frequency (AF) amplifier. The demodulated and detected signals may also be applied to means for determining the presence of a stereo pilot signal.

Figure 1B:
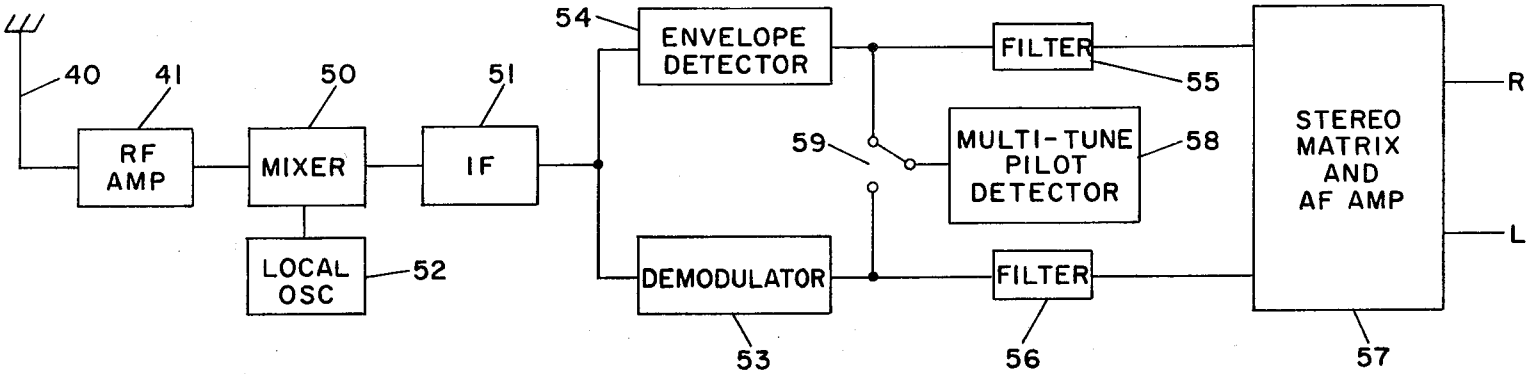

As illustrated in FIG. 1B, the carrier signals received by antenna 40 and amplified by RF amplifier 41 may be applied as an input to a superheterodyne circuit including mixer 50, local oscillator 52 and IF amplifier 51. The intermediate frequency signal is simultaneously detected by envelope detector 54 and demodulated by demodulator 53. The outputs from detector 54 and demodulator 53 are then filtered by filters 55 and 56, which may remove the low frequency pilot signals, and are applied to a stereo matrix and AF amplifier 57 to provide left and right (L and R) audio output signals. The outputs from detector 54 and demodulator 53 are also applied to pilot detector 58 via switch 59. When the pilot signals are amplitude modulated onto the carrier, the pilot detector 58 can detect the pilot signals in the output of detector 54 by placing switch 59 in the "up" position. When the pilot signals are phase or frequency modulated onto the carrier, the pilot detector 58 can detect the pilot signals in the output of demodulator 53 by placing switch 59 in the "down" position. The particular details of multi-tone pilot detector 58 according to the invention will be disclosed below with reference to FIGS. 2, 3 and 4.

Figure 2:
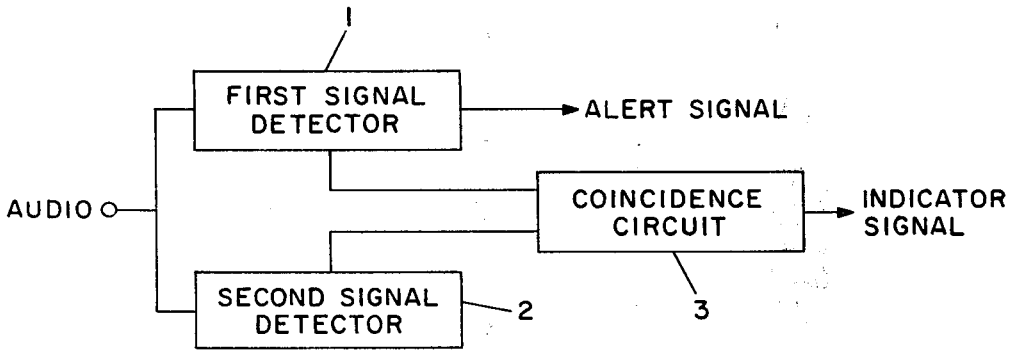
FIG. 2 is a functional block diagram of a two-tone pilot detector according to the invention.

In general, the audio frequency signal which may contain the multitone pilot signals is simultaneously applied to two signal detectors, one for each pilot signal frequency as shown in FIG. 2 For example, for a two-tone pilot signal, a first signal detector 1 and a second signal detector 2 are used to detect the two frequencies of the pilot signal. Assuming the presence of both the first and second signals, the output from each of the detectors may be applied to a coincidence circuit 3, which is a detector providing an indicator signal only when the detectors 1 and 2 indicate the presence of both the first and second signals. Furthermore, the output of either detector 1 or detector 2 may be also used to provide an alerting function. The purpose of such an alert function is to detect and indicate the possible presence of a stereo signal, thereby allowing the coincidence circuit 3 to confirm that a stereo signal has been received.

The alert signal is particularly useful in a scanning type radio receiver which scans at a rate which is faster than the response time of the combined circuit of FIG. 2. In prior art scanning type stereo receivers, the scanning rate may surpass the response time of the stereo pilot detecting circuit. In those cases, the prior art scanning receiver will bypass a particular signal including a pilot tone before the pilot detector has had an opportunity to detect the pilot tone. By the time the pilot tone is detected, the scanning receiver has passed the signal or, because of the scanning rate, the pilot detector simply fails to properly detect the tone at all. By employing a fast alert signal detector as detector 1 or 2, the scanning rate may be decreased whenever an alert signal is present to allow sufficient time to properly detect and indicate the presence of a stereo signal. It is also contemplated that more than two signals may be used to form the pilot signal. For example, for an n-tone pilot signal, n signal detectors would be used to detect the n frequencies of the pilot signal. The coincidence circuit would then indicate only when all n signals were detected. Alternatively, the coincidence circuit could indicate when a given number, such as a majority, of the n signals are present.

Figure 3:
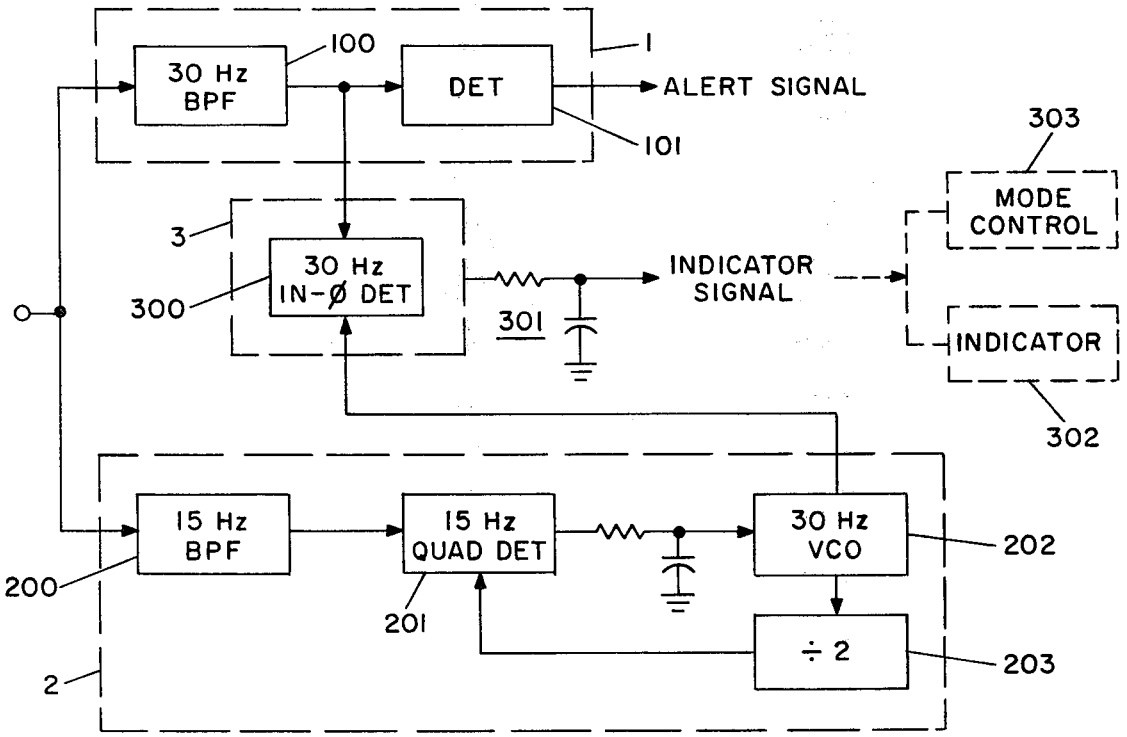
FIG. 3 is a block diagram illustrating a preferred embodiment of the invention of FIG. 2 wherein a single phase-locked loop is employed in combination with an in-phase detector to detect the presence of a two-tone stereo pilot signal.

In the preferred embodiment of the invention as illustrated in FIG. 3, the input is simultaneously provided to 30 Hz bandpass filter 100 and 15 Hz bandpass filter 200. The output of the 30 Hz bandpass filter 100 is fed to diode detector 101 to provide an alert signal. The output of the 15 Hz bandpass filter 200 is provided to a 15 Hz detector such as quadrature detector 201 forming a phase-locked loop with 30 Hz voltage controlled reference oscillator 202 and 2/1 divider 203. The outputs of the reference oscillator 202 and the signal from bandpass filter 100 are provided to a 30 Hz in-phase detector 300 which determines when both the 30 Hz and 15 Hz signals are present and in a predetermined phase relationship. When such a condition occurs, an indicator signal is provided through filter 301. The 15 Hz quadrature detector 201 is used to control the reference oscillator 202 to avoid a 180° phase ambiguity which would occur in the in-phase detector 300 if the reference oscillator 202 is controlled by a 30 Hz quadrature detector, instead of the 15 Hz quadrature detector 201, and if the 15 Hz phase detector is the in-phase detector.

It is contemplated that the indicator signal may be applied to indicator means 302 for providing a visual or audible indication that a stereo signal is present. The indicator signal may be also applied to mode control means 303 for controlling the mode of operation of the receiver. For example, the indicator signal may be applied to a mode control for switching an AM receiver from a monaural receiving mode to a stereo receiving mode.

In order to achieve positive stereo indication in the circuit of FIG. 3, a 15 Hz tone in a predetermined phase relationship with a 30 Hz tone must be present. The 15 Hz tone is applied through the 15 Hz bandpass filter 200 to the phase-locked loop and results in a correspondingly phased 30 Hz reference signal from voltage-controlled reference oscillator 202. The 30 Hz tone is applied through the 30 Hz bandpass filter 100 to the 30 Hz in-phase detector for comparison with the 30 Hz reference signal. It is contemplated that the 30 Hz in-phase detector 300 may be any type of comparative phase detector. For example, the in-phase detector may be a multiplier providing a maximum signal only when the 30 Hz tone and the signal from the reference oscillator are in-phase and providing a less than maximum signal in all other cases. Alternatively, the phase-locked loop may be structured to control the reference oscillator so as to provide a 30 Hz signal which is 180° out of phase with the 30 Hz tone. In such case, the 30 Hz in-phase detector 300 may be a multiplier which indicates a virtual ground condition only when the 30 Hz tone and the reference signal are 180° out of phase and provides a signal at all other times.

Figure 4:
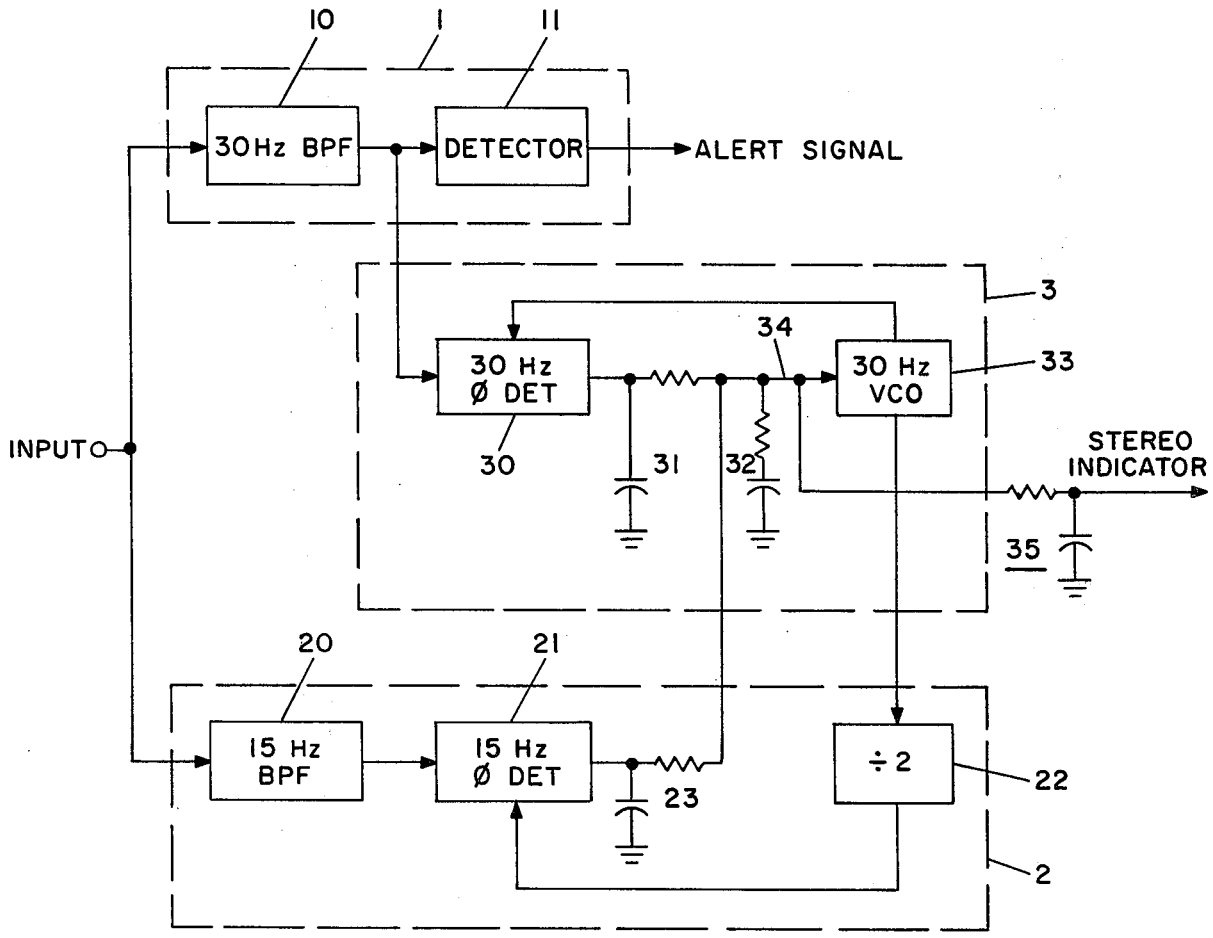
FIG. 4 is a block diagram illustrating an embodiment of the invention of FIG. 1 employing interrelated phase-locked loops to detect the two-tone stereo pilot signal.

FIG. 4 illustrates an embodiment of the invention for decoding a multiple tone pilot signal wherein like reference characters refer to similar aspects of the invention.

In particular, the incoming signal, including 15 Hz and 30 Hz low frequency tones, is simultaneously provided to detectors 1 and 2. Detector 1 comprises a 30 Hz bandpass filter 10 followed by a diode detector 11 which provides an alert signal in response to a 30 Hz signal passing through filter 10, indicating the possibility of stereo information. Detector 2 comprises part of a phase-locked loop and is interrelated with the coincidence circuit 3 which also forms a part of the phase-locked loop. In particular, detector 2 comprises 15 Hz bandpass filter 20 feeding a 15 Hz phase detector 21. The detector 21 is in a phase-locked loop with a 30 Hz voltage-controlled reference oscillator 33 and a 2/1 divider 22. The coincidence circuit 3 receives the input signal tapped off after the 30 Hz bandpass filter 10 and applies it to a 30 Hz phase detector 30 which forms part of a phase-locked loop with the oscillator 33. The input control 34 to the 30 Hz voltage-controlled reference oscillator 33 provides the actual indication confirming the presence of stereo intelligence by confirming that both the 15 Hz and 30 Hz tones are present in the desired phase relationship.

The circuit of FIG. 4 operates in the following manner. Assume that a composite AF input signal is applied to the input of the circuit of FIG. 4 and that such an input signal includes 15 Hz and 30 Hz signals. The composite signal is simultaneously applied to both the detectors 1 and 2. In detector 1, the 30 Hz signal is passed through the 30 Hz bandpass filter to the detector 11 to provide an alert signal indicating the possibility of stereo information. Simultaneously, the 15 Hz bandpass filter passes the 15 Hz signal to the 15 Hz phase detector which partially controls the reference oscillator 33. The presence of a 15 Hz signal phase locks the loop formed between detector 21, oscillator 33 and divider 22. The output from the 30 Hz bandpass filter is also tapped off and applied to a 30 Hz phase detector 30 which also partially controls the reference oscillator 33. The presence of the 30 Hz signal will cause the loop formed by detector 30 and oscillator 33 to phase lock. Since both detectors 21 and 30 control the reference oscillator 33, phase lock of both loops will only occur when the received 15 Hz and 30 Hz signals are in a predetermined phase relationship. When phase lock of both loops simultaneously occurs, the outputs of detectors 21 and 30 are selected to oppose each other at the input to the VCO 33 so they are equal and cancel, thereby providing an indication confirming that stereo intelligence is being transmitted along with the pilot signals. Reference characters 23, 31 and 32 refer to R-C low pass filters which are employed to enhance circuit operation by shunting high frequency signal components.

The embodiments illustrated in FIGS. 3 and 4 are particularly adapted to detect two low frequency tones which are harmonically related. The harmonic relation between the frequencies allows for an interrelation between the phase-locked loops so that a single reference oscillator may be used. In the particular case illustrated in FIG. 4, a 2/1 divider 22 is necessary to provide the proper reference frequency to phase detector 21. However, the invention comtemplates any type of frequency relationship between the two pilot tones. Furthermore, if the tones are not harmonically related, independent phase locked loops may be employed by using independent reference oscillators.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. In an AM multiphonic radio receiver, apparatus for detecting the presence of first and second low frequency pilot signals which are interrelated in frequency and phase and which are modulated on the AM carrier wave along with the multiphonic program information, said apparatus comprising:

(a) first means for detecting the presence of the first pilot signal in the modulation of a received AM radio wave and providing a first detection signal in response thereto;

(b) second means for detecting the presence of the second pilot signal in the modulation of said received AM radio wave and providing a second detection signal in response thereto; and (c) third means responsive to said first and second detection signals for determining whether said first pilot signal and said second pilot signal are present and in a predetermined phase relationship, and if so then providing an indicator signal indicating the reception of a multiphonic broadcast.

2. The apparatus of claim 1 wherein the first means includes a first bandpass filter for passing substantially only signals in a narrow band about the frequency of said first pilot signal, wherein the second means includes a second bandpass filter for passing substantially only signals in a narrow band about the frequency of said second pilot signal, and wherein the third means includes a phase detector providing an output whenever a signal passed by said first bandpass filter is in a predetermined phase relationship with a signal passed by said second bandpass filter.

3. The apparatus of claim 2 wherein said first means also includes a detector coupled to the output of said bandpass filter, and wherein the output signal from said bandpass filter is said first detection signal and the output signal from said detector indicates the presence of the first pilot signal in said received AM radio wave.

4. The apparatus of claim 2 wherein the second means includes a phase-locked loop responsive to signals passed by said second bandpass filter and having a reference oscillator operating at the frequency of said first pilot signal and having an output signal which is said second detection signal.

5. A method of indicating stereo signal presence in an AM stereo receiver and utilizing such stereo signal indication to control the receiver audio output mode comprising:

(a) modulating a first low frequency tone on a carrier wave together with stereo audio signals;

(b) modulating a second low frequency tone on said carrier wave, the frequency of said second tone being a predetermined multiple of the frequency of said first tone, and said second tone being in a predetermined phase relationship with respect to said first tone;

(c) transmitting the resulting modulated carrier wave;

(d) receving said transmitted signal and separately detecting the stereo audio signals in the receiver;

(e) detecting the first and second low frequency tones in said receiver; and (f) controlling the audio output channels of said receiver so as to apply stereo audio signals thereto when said first and second tones are simultaneously present and in said predetermined phase relationship.

6. Apparatus for generating an AM stereo signal including a pair of low frequency pilot signals related in frequency and phase, said apparatus comprising:

(a) means for supplying a carrier signal;

(b) means for supplying a pair of stereo information signals;

(c) means for supplying a first low frequency pilot signal;

(d) means for supplying a second low frequency pilot signal related in frequency and in phase to said first pilot signal;

(e) means for modulating said stereo signals onto the carrier signal; and (f) means for modulating said first and second pilot signals onto the carrier signal to indicate the presence of stereo information in the modulated carrier.

* * * * *